United States Patent [19]

Baechle et al.

[11] 4,036,526

[45] July 19, 1977

[54] FURNITURE SPRING SUPPORT

[76] Inventors: William G. Baechle, 1710 Russell Ave., Evansville, Ind. 47712; Edward L. Roehm, B-4 Old Courthouse, Evansville, Ind. 47708

[21] Appl. No.: 714,775

[22] Filed: Aug. 16, 1976

[51] Int. Cl.[2] ..... A47C 7/02

[52] U.S. Cl. ..... 297/452; 5/255; 267/103

[58] Field of Search ..... 5/246, 247, 255; 267/80, 103, 106, 452, 458–460

[56] References Cited

U.S. PATENT DOCUMENTS

| | | | |
|---|---|---|---|
| 2,678,685 | 5/1954 | Volsk | 5/255 X |
| 3,127,220 | 3/1964 | Stine | 297/452 |
| 3,463,547 | 8/1969 | Brennan et al. | 297/452 X |

*Primary Examiner*—James C. Mitchell

*Attorney, Agent, or Firm*—Woodard, Weikart, Emhardt & Naughton

[57] ABSTRACT

A spring support for a piece of furniture. The support includes a plastic sheet comprising a plurality of spaced apart ribs integrally joined together. The sheet includes a downwardly bowed portion joined by a first intermediate section to a front leg and joined by a second intermediate section to a rear leg. The legs are attachable to a furniture frame. The sheet varies in thickness with the minimum thickness occurring at the first and second intermediate sections located respectively adjacent the front and rear legs. The varying thickness and cross sectional area of the sheet provides for minimum deflection at the center portion of the sheet when downward force is applied thereto while maximum deflection occurs at the first and second intermediate section.

10 Claims, 6 Drawing Figures

FURNITURE SPRING SUPPORT

BACKGROUND OF THE INVENTION

1. Field of the Invention

This invention is in the field of furniture.

2. Description of the Prior Art

A representative sample of the prior art is disclosed in the following U.S. Patents:

U.S. Pat. No. 3,231,454 issued to R. J. Williams;
U.S. Pat. No. 3,251,077 issued to R. H. Beckman;
U.S. Pat. No. 3,606,461 issued to R. Moriyama;
U.S. Pat. No. 3,642,323 issued to W. F. Taylor; and
U.S. Pat. No. 3,811,728 issued to R. K. Redemske.

Generally, the prior art furniture seats provide a relatively hard, unyielding cushion effect or they provide a soft cushion effect allowing the person sitting on the seat to sink into the middle of the seat. Disclosed herein is a spring support for a furniture seat which provides a relatively firm cushion immediately beneath the person with the maximum amount of cushion deflection occurring adjacent the back edge portion and front edge portion of the cushion. Thus, the cushion will provide a relatively flat support while having resilience.

Many of the prior art furniture seats include a plurality of coiled springs and other members requiring relatively high production expense. Disclosed herein is a spring support which may be mass produced at very low cost as compared to the prior art device.

SUMMARY OF THE INVENTION

One embodiment of the present invention is a spring support for a piece of furniture comprising a plastic sheet to be incorporated into a piece of furniture, the sheet extending laterally across to form a seat and including a generally center portion to supportingly receive a person with the center portion having a generally curved convex configuration as viewed from above, the sheet further including a front end portion and a first intermediate portion between the front end portion and the center portion and further including a back end portion and a second intermediate portion between the back end portion and the center portion, the first intermediate portion and the second intermediate portion each having a cross sectional area less than the center portion and less than the front end portion and less than the back end portion providing a greater downward deflection of the first intermediate portion and of the second intermediate portion than of the center portion when a person is sitting atop of the center portion.

Another embodiment of the present invention is a piece of furniture comprising a frame with legs depending therefrom, a plastic sheet mounted to the frame, the sheet extending laterally across to form a seat and including a generally center portion to supportingly receive a person with the center portion having a generally curved configuration opening downwardly, the sheet further including a front edge portion and a first intermediate portion between the front edge portion and the center portion and further including a back edge portion and a second intermediate portion between the back edge portion and the center portion, the first intermediate portion and the second intermediate portion each having a cross sectional area less than the center portion and less than the front edge portion and less than the back edge portion providing a greater downward deflection of the first intermediate portion and of the second intermediate portion than of the center portion when a person is sitting atop of the center portion, and upholstery covering the sheet and frame.

It is an object of the present invention to provide a new and improved spring support for a furniture seat.

Another object of the present invention is to provide a new and improved piece of furniture.

Related objects and advantages of the present invention will be apparent from the following description.

DESCRIPTION OF THE PREFERRED EMBODIMENT

Figure 1:
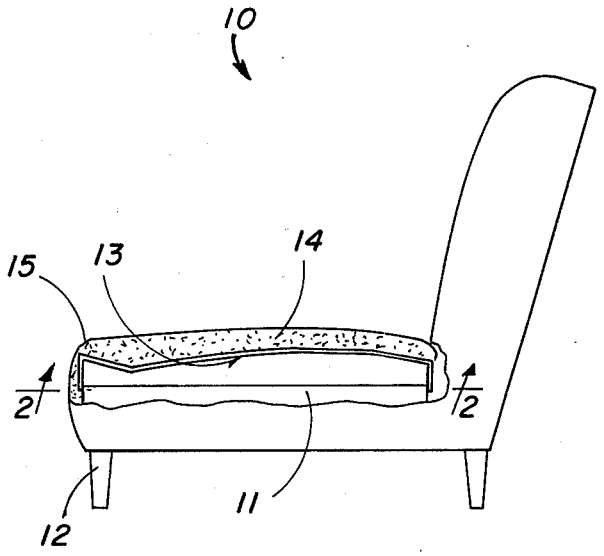
FIG. 1 is a fragmentary side view of a piece of furniture incorporating the present invention.
Figure 6:
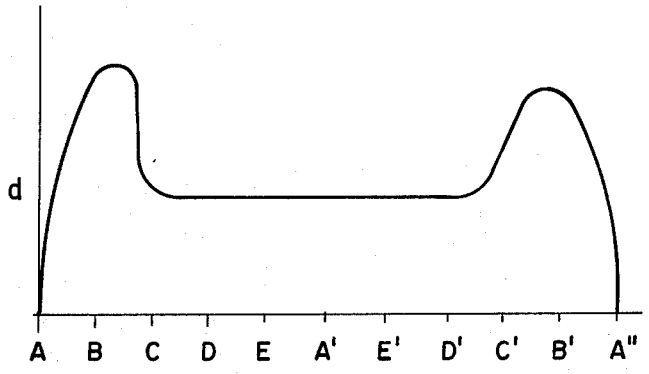
FIG. 6 is a graph showing the amount of deflection at various locations along the length of the spring support shown in FIG. 3 for a given amount of load.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a piece of furniture 10 including a frame 11 supported above the floor by a plurality of legs 12. Fixedly attached to frame 11 is a spring support 13 having a cushion 14 and upholstery 15 thereatop. The piece of furniture shown in the drawing is a chair; however, it is to be understood that the invention applies also to other types of furniture.

Figure 2:
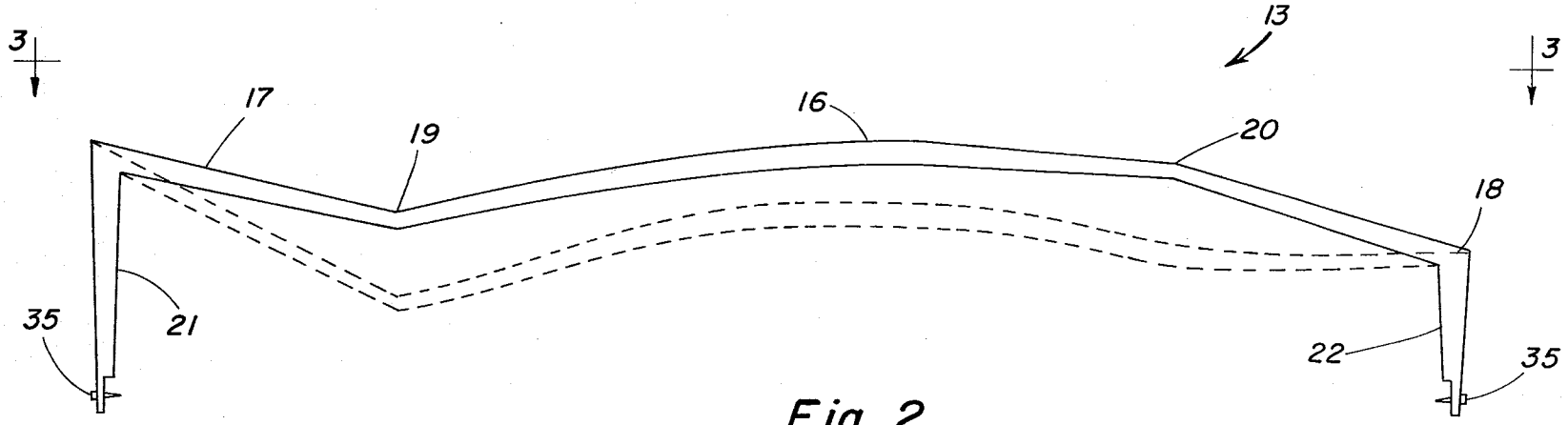
FIG. 2 is an enlarged cross sectional view of the spring support taken along the line 2—2 of FIG. 1 and viewed in the direction of the arrows.
Figure 3:
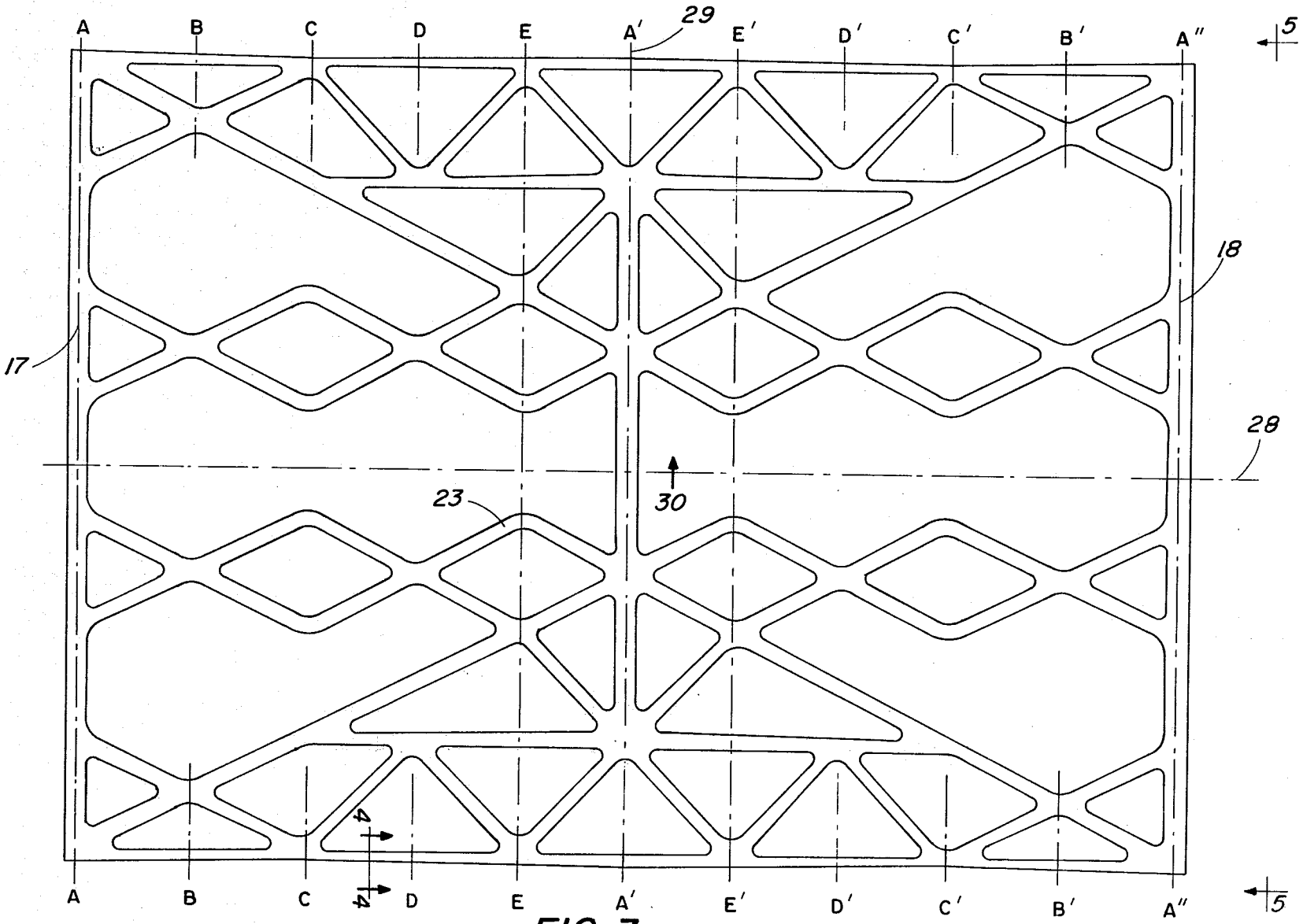
FIG. 3 is a plan view of the spring support of FIG. 2 looking in the direction of arrows 3—3.

A cross sectional enlarged view of spring support 13 is shown in FIG. 2. The spring support includes a plastic sheet which extends laterally across the furniture to form a seat. The sheet includes a generally center portion 16 which extends from the location indicated by the letter D to the location indicated by letter D′ (FIG. 3). The center portion 16 supportingly receives a person sitting atop the spring support. Center portion 16 has a generally curved configuration with the sheet being convex as viewed from above the sheet. In one embodiment, the center portion is not smoothly rounded but instead is composed of flat surfaces extending from location D to location E, from location E to location A′, from location A′ to location E′ and from location E′ to location D′.

Sheet 16 includes a front end portion 17 and a back end portion 18. A first intermediate portion 19 integrally connects center portion 16 with the front end portion 17 whereas a second intermediate portion 20 integrally connects the back end portion 18 to the center portion 16.

Figure 5:
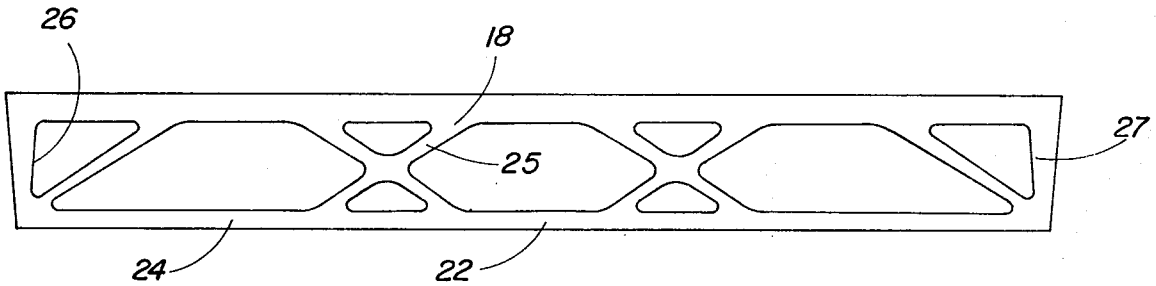
FIG. 5 is an end view looking in the direction of arrows 5—5 of FIG. 3.

A front leg 21 and a back leg 22 are integrally connected respectively to front end portion 17 and back end portion 18. Both legs extend downwardly from the sheet being attachable to a furniture frame. The sheet comprises a plurality of spaced apart ribs 23 (FIG. 3) which are integrally joined together. Likewise, the front and rear legs comprise a plurality of spaced apart ribs integrally joined together. For example, leg 22 is shown in FIG. 5 and includes a bottom rib 24 integrally joined to back end portion 18 by a plurality of diagonally extending ribs 25 and end ribs 26 and 27. Likewise, leg 21 has a wall configuration identical to leg 22 and includes a plurality of spaced apart ribs integrally joined together. A center axis 28 extends centrally through the sheet from the front end portion 17 to the back end portion 18. As shown in FIG. 3, the sheet is symmetrical about axis 28. A second axis 29 perpendicularly arranged to axis 28 extends centrally through the sheet at location A′ with the ribs being configured symmetrically with respect to axis 29.

The cross sectional area of the sheet varies along the length of the sheet in order to minimize deflection at location A′ and to maximize the deflection at locations C and C′. The thickness of the sheet is constant across the width of the sheet at any one particular location. For example, the thickness of the sheet at location A′ is constant across the width of the sheet with the width of the sheet extending in the direction of arrow 30. Likewise, the thickness of the sheet at, for example, location D′ is constant across the width of the sheet. The sheet has a maximum thickness at location A, A′ and A″ whereas the sheet has a minimum thickness at location C and C′. Location C (FIG. 3) corresponds to the location of the downward V-shaped portion 19 (FIG. 2) whereas location C′ corresponds to location 20. In one embodiment, the thickness of the sheet at location C and C′ was 0.330 inches whereas the thickness of the sheet at A, A′ and A″ in the same embodiment was 0.530 inches. Thus, the intermediate portion 19 and 20 have a cross sectional thickness less than the cross sectional thickness of center portion 16 and also less than the cross sectional thickness of the front end portion 17 and back end portion 18. In addition, the number of ribs at location C and C′ is less than the number of ribs at locations A, A′ and A″ thereby providing for a total cross sectional area which is less at locations C and C′ as compared to locations A, A′ and A″. The result is a greater downward deflection at the intermediate portions 19 and 20 than at the center portion when a person is sitting atop the center portion. The thickness of the ribs generally decrease from location A to location C and from location A″ to location C′. The thickness of the sheet gradually increases from location C to location A′ and from location C′ to location A′. In the same embodiment as previously described, the thickness at locations B and B′ of the ribs was 0.430 inches whereas the sheet thickness at location D and D′ was 0.398 inches. The thickness at location E and E′ was 0.464 inches.

Figure 4:
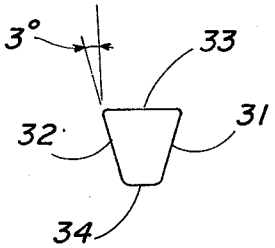
FIG. 4 is an enlarged cross sectional view taken along the line 4—4 of FIG. 3 and viewed in the direction of the arrows.

A deflection curve for the spring support is shown in FIG. 5 indicating that for a given load the amount of deflection *d* for the center portion 16 generally on either side of location A′ is relatively constant whereas the deflection increases significantly at locations C and C′ with the deflection being zero at location A and A″. A cross sectional view of one of the ribs is shown in FIG. 4 with the sides of the rib 31 and 32 slightly converging from the top surface 33 toward the bottom surface 34 of the rib. In one embodiment, side 32 (FIG. 4) of the rib was an angle of approximately 3° with respect to vertical. Likewise, side 31 was at an angle of approximately 3° with respect to the vertical.

As shown in FIG. 2, the top surface of the intermediate portion 19 is lower in elevation than either the top surface of the front end portion 17 or the top surface of the center portion 16. In addition, the intermediate portion 19 is lower in elevation than the second intermediate portion 20 with intermediate portion 19 having a generally V-shaped configuration providing a hinged connection between the front end portion 17 and the center portion 16. With force applied downward to the center portion 16, the spring support assumes a position as shown by the dashed lines in FIG. 2 with a maximum deflection occurring at location C and C′. The maximum shear force occurs at the hinged joint located at location C with the stress being constant throughout the sheet from front end portion 17 to back end portion 18 due to the varying cross sectional thickness. Center portion 16 will rotate about the V-shaped intermediate portion 19 as downward force is applied to center portion 16. A relatively flat deflection will occur throughout the center portion 16. Front end portion 17 and back end portion 18 due to the thickness at the edge of the sheet, are rigid joints even though legs 21 and 20 are fixed to the frame by fasteners 35.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A spring support for a piece of furniture comprising:

a plastic sheet to be incorporated into a piece of furniture, said sheet extending laterally across to form a seat and including a generally center portion to supportingly receive a person with said center portion having a generally curved convex configuration as viewed from above, said sheet further including a front end portion and a first intermediate portion between said front end portion and said center portion and further including a back end portion and a second intermediate portion between said back end portion and said center portion, said sheet including a straight longitudinal axis extending from said front edge portion to said back edge portion, said first intermediate portion and said second intermediate portion being integral with said center portion and being located along said longitudinal axis outwardly of said center portion, said first intermediate portion and said second intermediate portion each having a cross sectional area less than said center portion and less than said front end portion and less than said back end portion providing a greater downward deflection of said first intermediate portion and of said second intermediate portion than of said center portion when a person is sitting atop of said center portion.

2. The spring support of claim 1 wherein:

said first intermediate portion has an upwardly looking V-shaped configuration and is lower in elevation than said front end portion and said center portion and said second intermediate portion providing a hinge connection between said front end portion and said center portion; said second intermediate portion having an inverted V-shaped configuration.

3. The spring support of claim 2 wherein:

said sheet has a total area cross sectional thickness decreasing from said front end portion to a minimum thickness at said first intermediate portion and from said rear end portion to a maximum thickness at said second intermediate portion, said sheet has a total area cross sectional thickness increasing from said first intermediate portion to said center portion and from said second intermediate portion to said center portion providing a relative constant deflection of said center portion when under load.

4. The spring support of claim 3 and further comprising:

a front leg integrally joined to said front end portion and extending downwardly therefrom being attachable to a furniture frame; and, a rear leg integrally joined to said back end portion and extending downwardly therefrom being attachable to a furniture leg.

5. The spring support of claim 4 wherein:

said sheet comprises a plurality of spaced apart ribs integrally joined together, said front leg is a wall which comprises a plurality of spaced apart ribs integrally joined together, said rear leg is a wall which comprises a plurality of spaced apart ribs integrally joined together.

6. The spring support of claim 5 wherein:

said sheet is symmetrical about said longitudinal axis.

7. A piece of furniture comprising:

a frame with legs depending therefrom;

a plastic sheet mounted to said frame, said sheet extending laterally across to form a seat and including a generally center portion to supportingly receive a person with said center portion having a generally curved configuration opening downwardly, said sheet further including a front edge portion and a first intermediate portion between said front edge portion and said center portion and further including a back edge portion and a second intermediate portion between said back edge portion and said center portion, said sheet including a straight longitudinal axis extending from said front edge portion to said back edge portion, said first intermediate portion and said second intermediate portion being integrally with said center portion and being located along said longitudinal axis outwardly of said center portion, said first intermediate portion and said second intermediate portion each having a cross sectional area less than said center portion and less than said front edge portion and less than said back edge portion providing a greater downward deflection of said first intermediate portion and of said second intermediate portion than of said center portion when a person is sitting atop of said center portion; and, upholstery covering said sheet and frame.

8. The piece of furniture of claim 7 wherein:

said first intermediate portion has a V-shaped configuration and is lower in elevation than said front edge portion and said center portion and said second intermediate portion providing a hinge connection between said front edge portion and said center portion.

9. The piece of furniture of claim 8 wherein:

said sheet has a cross sectional thickness decreasing from said front edge portion to said first intermediate portion and from said rear edge portion to said second intermediate portion, said sheet has a cross sectional thickness increasing from said first intermediate portion to said center portion and from said second intermediate portion to said center portion providing a constant deflection of said center portion when loaded.

10. The piece of furniture of claim 9 and further comprising:

a front leg integrally joined to said front edge portion and extending downwardly therefrom being attached to said frame; and, a rear leg integrally joined to said back edge portion and extending downwardly therefrom being attached to said frame.

* * * * *

UNITED STATES PATENT OFFICE

CERTIFICATE OF CORRECTION

Patent No. 4,036,526 Dated July 19, 1977

Inventor(s) William G. Baechle and Edward L. Roehm

It is certified that error appears in the above-identified patent and that said Letters Patent are hereby corrected as shown below:

In column 5 line 9, please replace the word "maximum" with the word --minimum--.

In column 6 line 6, please replace the word "integrally" with the word --integral--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*